US011790824B2

(12) United States Patent
Liao

(10) Patent No.: US 11,790,824 B2
(45) Date of Patent: Oct. 17, 2023

(54) DISPLAY METHOD, DISPLAY DEVICE, AND DISPLAY APPARATUS

(71) Applicant: Shenzhen China Star Optoelectronics Semiconductor Display Technology Co., Ltd., Guangdong (CN)

(72) Inventor: Wenwu Liao, Guangdong (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 479 days.

(21) Appl. No.: 17/040,992

(22) PCT Filed: Aug. 4, 2020

(86) PCT No.: PCT/CN2020/106763

§ 371 (c)(1),
(2) Date: Sep. 24, 2020

(87) PCT Pub. No.: WO2022/000697

PCT Pub. Date: Jan. 6, 2022

(65) Prior Publication Data

US 2023/0108255 A1 Apr. 6, 2023

(30) Foreign Application Priority Data

Jul. 3, 2020 (CN) ..... 202010635943.7

(51) Int. Cl.
*G09G 3/20* (2006.01)

(52) U.S. Cl.
CPC ..... *G09G 3/2007* (2013.01); *G09G 2310/08* (2013.01); *G09G 2320/0233* (2013.01); *G09G 2360/16* (2013.01)

(58) Field of Classification Search
None
See application file for complete search history.

(56) References Cited

U.S. PATENT DOCUMENTS

| | | | | |
|---|---|---|---|---|
| 10,049,642 | B2 | 8/2018 | Ansari | |
| 2013/0106876 | A1 | 5/2013 | Lee et al. | |
| 2018/0012556 | A1 | 1/2018 | Hsu et al. | |
| 2020/0066215 | A1* | 2/2020 | Koo | G09G 3/3607 |
| 2021/0272531 | A1* | 9/2021 | Shin | G09G 3/3677 |

FOREIGN PATENT DOCUMENTS

| | | |
|---|---|---|
| CN | 101097709 | 1/2008 |
| CN | 106098018 | 11/2016 |
| CN | 107045859 | 8/2017 |
| KR | 10-2016-0094513 | 8/2018 |

* cited by examiner

*Primary Examiner* — Matthew Yeung

(57) ABSTRACT

A display method, a display device, and a display apparatus are provided. The display method includes following steps: obtaining a current frame display period corresponding to a current refresh frequency of a GPU, wherein the current frame display period is a sum of a duration of a frame display and a duration of a vertical blank region; determining a start time and a lasting duration of the vertical blank region based on a preset frame display duration and the current frame display period; and controlling a target image to be displayed from the start time according to the lasting duration.

7 Claims, 3 Drawing Sheets

DISPLAY METHOD, DISPLAY DEVICE, AND DISPLAY APPARATUS

RELATED APPLICATIONS

This application is a National Phase of PCT Patent Application No. PCT/CN2020/106763 having International filing date of Aug. 4, 2020, which claims the benefit of priority of Chinese Patent Application No. 202010635943.7 filed on Jul. 3, 2020. The contents of the above applications are all incorporated by reference as if fully set forth herein in their entirety.

FIELD AND BACKGROUND OF THE INVENTION

The present invention relates to the field of display technologies, and in particular, to a display method, a display device, and a display apparatus.

At present, many display devices have a display frequency conversion function. For example, with development of the display devices in a direction of games, in order to solve a problem of stuttering and tearing under high refresh frequency screens, many display devices have supported display frequency conversion technology (Freesync) functions.

In related technologies, the Freesync functions are to adjust a time when a cathode ray in a display device returns to an output again after outputting a frame of image, that is, a V-Blank (vertical blank), to dynamically adjust the display device. However, since a low refresh frequency is to maintain a grayscale brightness during a vertical blank period, a hold time of a pixel capacitor voltage is bound to be longer than a high refresh frequency. The longer the hold time is, the more leakage there will be, and gray-scale voltages will change, resulting in a greater difference in gray-scale brightness.

Therefore, current technologies have defects and are in urgent need of improvement.

SUMMARY OF THE INVENTION

Embodiments of the present invention provide a display method, a display device, and a display apparatus, which can prevent large differences in grayscale brightness changes.

In a first aspect, an embodiment of the present invention provides a display method, comprising following steps:

obtaining a current frame display period corresponding to a current refresh frequency of a GPU, wherein the current frame display period is a sum of a duration of a frame display and a duration of a vertical blank region;

determining a start time and a lasting duration of the vertical blank region based on a preset frame display duration and the current frame display period; and controlling a target image to be displayed from the start time according to the lasting duration.

In the display method described in the present invention, the step of obtaining the current frame display period corresponding to the current refresh frequency of the GPU comprises:

obtaining the current refresh frequency of the GPU and determining whether the current refresh frequency is less than a preset refresh frequency;

If the current refresh frequency is less than the preset refresh frequency, the current frame display period corresponding to the current refresh frequency is obtained.

In the display method described in the present invention, the step of determining the start time and the lasting duration of the vertical blank region based on the preset frame display duration and the current frame display period comprises:

determining the start time and the lasting duration of the vertical blank region according to a preset frame generation duration and the current frame display period, and determining the duration from the start time of the current frame display period to an end of the current display period as the lasting duration of the vertical blank region.

In the display method described in the present invention, the preset refresh frequency is any value from 70 Hz to 90 Hz.

In the display method described in the present invention, the target image is a high grayscale brightness image.

In a second aspect, an embodiment of the present invention further provides a display device, comprising:

an obtaining unit configured to obtain a current frame display period corresponding to a current refresh frequency of a GPU, wherein the current frame display period is a sum of a duration of a frame display and a duration of a vertical blank region;

a determining unit configured to determine a start time and a lasting duration of a vertical blank region based on a preset frame display duration and the current frame display period; and a control unit configured to control a target image to be displayed from the start time according to the lasting duration.

In the display device described in the present invention, the obtaining unit comprises:

a judgment subunit configured to obtain the current refresh frequency and judge whether the current refresh frequency is less than the preset refresh frequency; and an obtaining subunit configured to obtain the current frame display period corresponding to the current refresh frequency if the current refresh frequency is less than the preset refresh frequency.

In the display device described in the present invention, the determining unit comprises:

a determining subunit configured to determine the start time and the lasting duration of the vertical blank region according to a preset frame generation duration and the current frame display period, and determine the duration from the start time of the current frame display period to an end of the current display period as the lasting duration of the vertical blank region.

In the display device described in the present invention, the preset refresh frequency is any value from 70 Hz to 90 Hz.

In a third aspect, an embodiment of the present invention further provides a display apparatus, comprising a memory, a processor, and a computer program stored in the memory and executable in the processor, wherein a display method is realized when the processor executes the program, and the display method comprises following steps:

obtaining a current refresh frequency of a GPU and determining whether the current refresh frequency is less than a preset refresh frequency;

If the current refresh frequency is less than the preset refresh frequency, a current frame display period corresponding to the current refresh frequency is obtained, wherein the current frame display period is a sum of a duration of a frame display and a duration of a vertical blank region;

determining a start time and a lasting duration of the vertical blank region based on a preset frame display duration and the current frame display period; and controlling a target image to be displayed from the start time according to the lasting duration, wherein the target image is a high grayscale brightness image.

In the display apparatus described in the present invention, the step of determining the start time and the lasting duration of the vertical blank region based on the preset frame display duration and the current frame display period comprises:

determining the start time and the lasting duration of the vertical blank region according to a preset frame generation duration and the current frame display period, and determining the duration from the start time of the current frame display period to an end of the current display period as the lasting duration of the vertical blank region.

In the display apparatus described in the present invention, the preset refresh frequency is any value from 70 Hz to 90 Hz.

A display method of the present invention comprises following steps: obtaining a current frame display period corresponding to a current refresh frequency of a GPU, wherein the current frame display period is a sum of a duration of a frame display and a duration of a vertical blank region; determining a start time and a lasting duration of the vertical blank region based on a preset frame display duration and the current frame display period; and controlling a target image to be displayed from the start time according to the lasting duration. By inserting the target image in the vertical blank region, a problem of excessive grayscale brightness changes in the vertical blank region is prevented.

BRIEF DESCRIPTION OF THE SEVERAL VIEWS OF THE DRAWINGS

In order to illustrate the embodiments or the technical solutions more clearly in the prior art, a brief introduction of the drawings used in the embodiments or the prior art description will be briefly described below. Obviously, the drawings in the following description are only some of the embodiments of the invention, and those skilled in the art can obtain other drawings according to the drawings without any creative work.

DESCRIPTION OF SPECIFIC EMBODIMENTS OF THE INVENTION

Figure 1:
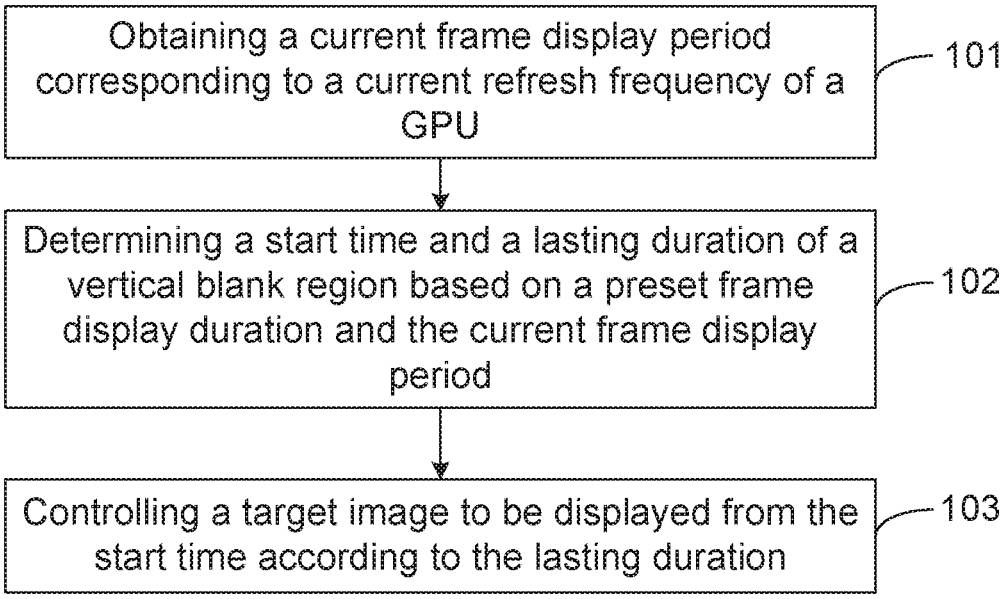
FIG. 1 is a schematic flowchart of a display method provided by an embodiment of the present invention.

The following will clearly and completely describe the technical solutions in the embodiments of the present invention with reference to the drawings in the embodiments of the present invention. Obviously, the described embodiments are only a part of the embodiments of the present invention, rather than all the embodiments. Based on the embodiments in the present invention, all other embodiments obtained by those skilled in the art without creative work are within the protection scope of the present invention.

In the prior art, displays with display frequency conversion technologies (Freesync) need to pass certifications of graphics card organizations. A certification standard is that a brightness difference/frequency difference is ≤0.03 nit/Hz within a frequency variation range advertised by the displays (for example: 48-144 HZ), that is, Lmax−Lmin/Fmax−Fmin≤0.03. Because Freesync technologies dynamically adjust a refresh frequency of the displays by changing a sum (Vtt) of a display duration and a duration of a vertical blank region, and meanwhile, due to a limitation of in-plane process technologies, when the refresh frequency is reduced, a Vtt time will be longer, so there will be more serious leakage when the frequency changes, this results in a large brightness difference during the Freesync certification process and failure to pass.

The embodiment of the present invention provides a display method, comprising following steps:

obtaining a current frame display period corresponding to a current refresh frequency of a GPU, wherein the current frame display period is a sum of a duration of a frame display and a duration of a vertical blank region;

determining a start time and a lasting duration of the vertical blank region based on a preset frame display duration and the current frame display period; and controlling a target image to be displayed from the start time according to the lasting duration.

Wherein the step of obtaining the current frame display period corresponding to the current refresh frequency of the GPU comprises:

obtaining the current refresh frequency of the GPU and determining whether the current refresh frequency is less than a preset refresh frequency;

if the current refresh frequency is less than the preset refresh frequency, the current frame display period corresponding to the current refresh frequency is obtained.

Wherein the step of determining the start time and the lasting duration of the vertical blank region based on the preset frame display duration and the current frame display period comprises:

determining the start time and the lasting duration of the vertical blank region according to a preset frame generation duration and the current frame display period, and determining the duration from the start time of the current frame display period to an end of the current display period as the lasting duration of the vertical blank region.

Wherein the preset refresh frequency is any value from 70 Hz to 90 Hz.

Wherein the target image is a high grayscale brightness image.

Please refer to FIG. 1. FIG. 1 is a schematic flowchart of the display method provided by an embodiment of the present invention. The display method comprises following steps:

Step 101, obtaining the current frame display period corresponding to the current refresh frequency of the GPU.

The current refresh frequency of the GPU is a current refresh frequency of a graphics card in an apparatus connected to a display apparatus. The apparatus can be a host, a tablet, a personal digital assistant, and other apparatus, which is not limited here. The current frame display period is a total duration from a generation of one frame to the next frame. That is, the current frame display period is the sum (Vtt) of the duration of the frame display and the duration of the vertical blank region.

In some embodiments, the step of obtaining the current frame display period corresponding to the current refresh frequency of the GPU comprises:

(1) obtaining the current refresh frequency of the GPU and determining whether the current refresh frequency is less than a preset refresh frequency;

(2) if the current refresh frequency is less than the preset refresh frequency, the current frame display period corresponding to the current refresh frequency is obtained.

Vtt is inversely proportional to the current refresh frequency of the GPU. If the current refresh frequency of the GPU is higher, the Vtt time is shorter, that is, the vertical blank region is shorter. In this case, a TFT inside the display apparatus does not have a long time to discharge, so a leakage is not serious, and a brightness difference is small. Conversely, if the current refresh frequency of the GPU is low, the Vtt time is longer, that is, the vertical blank region is longer. In this case, the TFT inside the display apparatus has a long time to discharge, so the leakage is serious, and the brightness difference is large. Therefore, when the current refresh frequency of the GPU is low, there will be a large difference in brightness caused by the leakage. Thus, a preset refresh frequency can be set, and based on the preset refresh frequency, it is judged whether the current refresh frequency of the GPU will affect the leakage of the TFT and cause a large brightness difference.

When the current refresh frequency of the GPU is less than the preset refresh frequency, obtain the current frame display period corresponding to the current refresh frequency.

In some embodiments, the preset refresh frequency is any value from 70 Hz to 90 Hz.

Step 102, determining the start time and the lasting duration of the vertical blank region based on the preset frame display duration and the current frame display period.

The duration of the frame display on the display apparatus is fixed. When the Vtt is determined, the starting time of the vertical blank region can be determined according to a Vtt duration and the preset frame display duration, and the duration of the vertical blank region can be determined.

In some embodiment, the step of determining the start time and the lasting duration of the vertical blank region based on the preset frame display duration and the current frame display period comprises:

determining the start time and the lasting duration of the vertical blank region according to the preset frame generation duration and the current frame display period, and determining the duration from the start time of the current frame display period to an end of the current display period as the lasting duration of the vertical blank region.

For example: Vtt is 0.02 s, the preset frame display duration is 0.01 s, and then the starting time of the vertical blank region is 0.01 s in Vtt, and the duration is 0.02 s−0.01 s=0.01 s.

Step 103, controlling the target image to be displayed from the start time according to the lasting duration.

In order to prevent the leakage of the TFT caused by the excessively long duration of the vertical blank region, some target images can be added at the start time of the vertical blank region, that is, to prevent occurrence of the leakage of the TFT by adding images. Then, the target images to be displayed can be controlled according to the duration from the start time.

In some embodiments, the target image is a high grayscale brightness image.

In order to pass a Freesync certification, the target image can be set to a high-brightness grayscale image to prevent the problem of excessive brightness difference.

Figure 2:
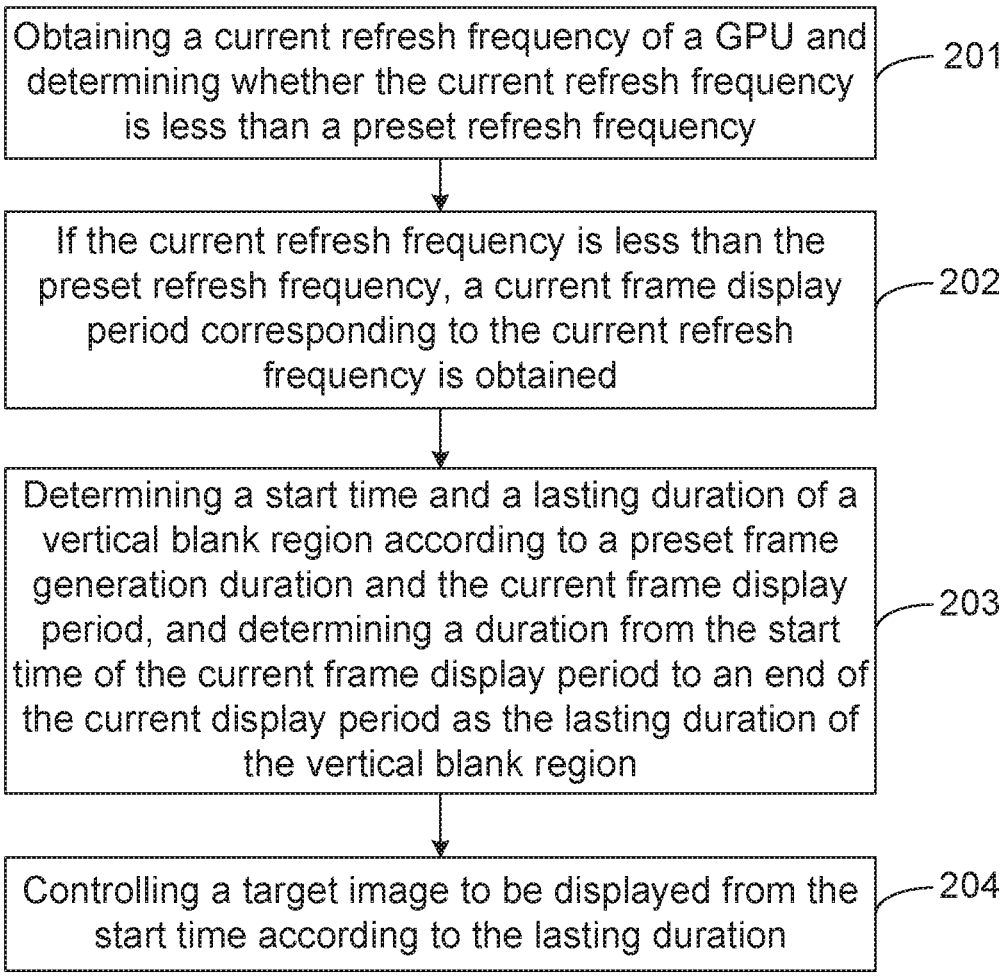
FIG. 2 is another schematic flowchart of a display method provided by an embodiment of the present invention.

Please refer to FIG. 2. FIG. 2 is a schematic flowchart of another display method provided by an embodiment of the present invention. The flowchart of the method can comprise following steps:

Step 201, obtaining the current refresh frequency of the GPU and determining whether the current refresh frequency is less than the preset refresh frequency.

The current refresh frequency of the GPU is the current refresh frequency of the graphics card in the apparatus connected to the display apparatus. The apparatus can be the host, the tablet, the personal digital assistant, and other apparatuses, which is not limited here. The current frame display period is the total duration from the generation of one frame to the next frame. That is, the current frame display period is the sum (Vtt) of the duration of the frame display and the duration of the vertical blank region. Vtt is inversely proportional to the current refresh frequency of the GPU. If the current refresh frequency of the GPU is higher, the Vtt time is shorter, that is, the vertical blank region is shorter. In this case, the TFT inside the display apparatus does not have a long time to discharge, so the leakage is not serious, and the brightness difference is small. Conversely, if the current refresh frequency of the GPU is low, the Vtt time is longer, that is, the vertical blank region is longer. In this case, the TFT inside the display apparatus has a long time to discharge, so the leakage is serious, and the brightness difference is large. Therefore, when the current refresh frequency of the GPU is low, there will be a large difference in brightness caused by the leakage. Thus, the preset refresh frequency can be set, and based on the preset refresh frequency, it is judged whether the current refresh frequency of the GPU will affect the leakage of the TFT and cause the large brightness difference.

Step 202, if the current refresh frequency is less than the preset refresh frequency, the current frame display period corresponding to the current refresh frequency is obtained.

When the current refresh frequency of the GPU is less than the preset refresh frequency, obtain the current frame display period corresponding to the current refresh frequency. Further, the preset refresh frequency is any value from 70 Hz to 90 Hz.

Step 203, determining the start time and the lasting duration of the vertical blank region according to the preset frame generation duration and the current frame display period, and determining the duration from the start time of the current frame display period to the end of the current display period as the lasting duration of the vertical blank region.

The duration of the frame display on the display apparatus is fixed. When the Vtt is determined, the starting time of the vertical blank region can be determined according to the Vtt duration and the preset frame display duration, and the duration of the vertical blank region can be determined.

For example: Vtt is 0.02 s, the preset frame display duration is 0.01 s, and then the starting time of the vertical blank region is 0.01 s in Vtt, and the duration is 0.02 s−0.01 s=0.01 s.

Step 204, controlling the target image to be displayed from the start time according to the lasting duration.

In order to prevent the leakage of the TFT caused by the excessively long duration of the vertical blank region, some target images can be added at the start time of the vertical blank region, that is, to prevent the occurrence of the leakage of the TFT by adding the images. Then, the target images to be displayed can be controlled according to the duration from the start time.

Further, in order to pass the Freesync certification, the target image can be set to the high-brightness grayscale image to prevent the problem of excessive brightness difference.

The embodiment of the present invention further provides a display device, comprising:

an obtaining unit configured to obtain the current frame display period corresponding to the current refresh frequency of the GPU, wherein the current frame display period is the sum of the duration of the frame display and the duration of the vertical blank region;

a determining unit configured to determine the start time and the lasting duration of the vertical blank region based on the preset frame display duration and the current frame display period; and a control unit configured to control the target image to be displayed from the start time according to the lasting duration.

Wherein the obtaining unit comprises:

a judgment subunit configured to obtain the current refresh frequency and judge whether the current refresh frequency is less than the preset refresh frequency; and an obtaining subunit configured to obtain the current frame display period corresponding to the current refresh frequency if the current refresh frequency is less than the preset refresh frequency.

Wherein the determining unit comprises:

a determining subunit configured to determine the start time and the lasting duration of the vertical blank region according to the preset frame generation duration and the current frame display period, and determine the duration from the start time of the current frame display period to the end of the current display period as the lasting duration of the vertical blank region.

Wherein the preset refresh frequency is any value from 70 Hz to 90 Hz.

Figure 3:
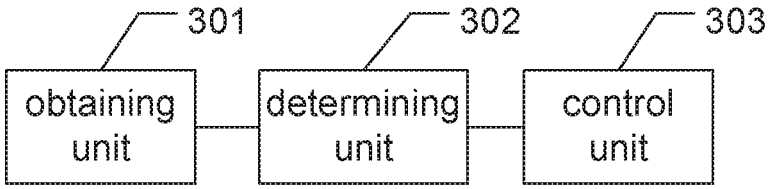
FIG. 3 is a schematic structural view of a display device provided by an embodiment of the present invention.

Please refer to FIG. 3. FIG. 3 is a schematic structural view of the display device provided by the embodiment of the present invention. The display device may comprise the obtaining unit 301, the determining unit 302, the control unit 303, etc.

The obtaining unit 301 is configured to obtain the current frame display period corresponding to the current refresh frequency of the GPU. The current frame display period is the sum of the duration of the frame display and the duration of the vertical blank region;

The determining unit 302 is configured to determine the start time and the lasting duration of the vertical blank region based on the preset frame display duration and the current frame display period.

The control unit 303 is configured to control the target image to be displayed from the start time according to the lasting duration.

In some embodiment, the obtaining unit 301 comprises:

the judgment subunit configured to obtain the current refresh frequency and judge whether the current refresh frequency is less than the preset refresh frequency; and the obtaining subunit configured to obtain the current frame display period corresponding to the current refresh frequency if the current refresh frequency is less than the preset refresh frequency.

In some embodiment, the determining unit 302 comprises:

the determining subunit configured to determine the start time and the lasting duration of the vertical blank region according to the preset frame generation duration and the current frame display period, and determine the duration from the start time of the current frame display period to the end of the current display period as the lasting duration of the vertical blank region.

In some embodiment, the preset refresh frequency is any value from 70 Hz to 90 Hz.

The embodiment of the present invention further provides the display apparatus comprising a memory, a processor, and a computer program stored in the memory and executable in the processor, wherein a display method is realized when the processor executes the program, and the display method comprises following steps:

obtaining a current refresh frequency of a GPU and determining whether the current refresh frequency is less than a preset refresh frequency;

if the current refresh frequency is less than the preset refresh frequency, a current frame display period corresponding to the current refresh frequency is obtained, wherein the current frame display period is a sum of a duration of a frame display and a duration of a vertical blank region;

determining a start time and a lasting duration of the vertical blank region based on a preset frame display duration and the current frame display period; and controlling a target image to be displayed from the start time according to the lasting duration, wherein the target image is a high grayscale brightness image.

Wherein the step of determining the start time and the lasting duration of the vertical blank region based on the preset frame display duration and the current frame display period comprises:

determining the start time and the lasting duration of the vertical blank region according to a preset frame generation duration and the current frame display period, and determining the duration from the start time of the current frame display period to an end of the current display period as the lasting duration of the vertical blank region.

Wherein the preset refresh frequency is any value from 70 Hz to 90 Hz.

Figure 4:
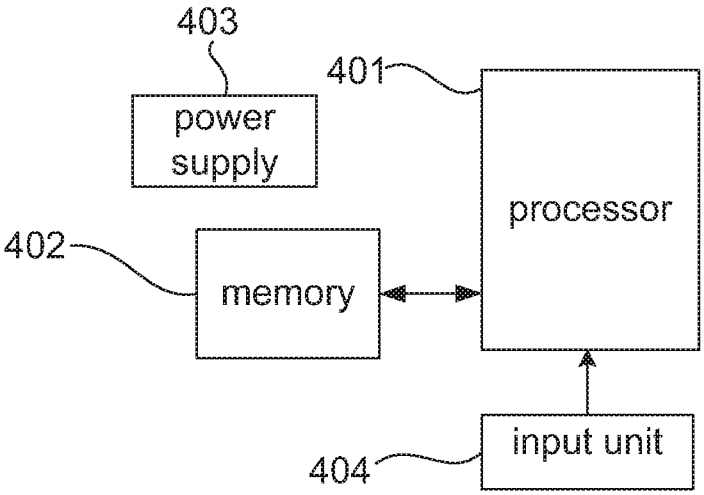
FIG. 4 is a schematic structural view of a display apparatus provided by an embodiment of the present invention.

The embodiment of the present invention further provides the display apparatus, as shown in FIG. 4, which shows a schematic structural diagram of the display apparatus involved in the embodiment of the present invention, specifically:

The display apparatus may comprise one or more processing core processors 401, one or more computer-readable storage medium memories 402, a power supply 403, an input unit 404, and other components. Those skilled in the art can understand that the structure of the display apparatus shown in FIG. 4 does not constitute a limitation on the display apparatus, and may comprise more or less components than those shown in the figure, or a combination of certain components, or different component arrangements. Wherein:

The processor 401 is a control center of the display apparatus and uses various interfaces and lines to connect various parts of the entire display apparatus. By running or executing software programs and/or modules stored in the memory 402, and calling data stored in the memory 402, various functions and processing data of the display apparatus are executed, thereby achieving overall monitoring of the display apparatus. Optionally, the processor 401 may comprise one or more processing cores. Optionally, the processor 401 can integrate an application processor and a modem processor. The application processor mainly deals with an operating system, user interface and application programs, and the modem processor mainly deals with wireless communication. It is understandable that the above modem processor may not be integrated into the processor 401.

The memory 402 can be used to store software programs and modules. The processor 401 executes various functional applications and data processing by running the software programs and modules stored in the memory 402. The memory 402 may mainly comprise a program storage area and a data storage area. The storage program area can store the operating system, at least one application program required by the function (such as sound playback function, image playback function, etc.); the storage data area can store data created according to the use of the server, etc. In addition, the memory 402 may comprise high-speed random-access memory, and may also comprise non-volatile memory. For example, at least one disk storage device, flash memory device, or other volatile solid-state storage device. Correspondingly, the memory 402 may also comprise a memory controller to provide the processor 401 with access to the memory 402.

The display apparatus further comprises the power supply 403 for powering various components. Optionally, the power supply 403 may be logically connected to the processor 401 through a power management system, so that functions such as charging, discharging, and power consumption management can be managed through the power management system. The power supply 403 may also comprise one or more DC or AC power supplies, recharging systems, power failure detection circuits, power converters or inverters, power status indicators and other arbitrary components.

The display apparatus may further comprise the input unit 404. The input unit 404 can be used to receive input digital or character information, and generate keyboard, mouse, joystick, optical or trackball signal input related to user settings and function control.

Although not shown, the display apparatus may further comprise a display unit, etc., which will not be repeated here. Specifically, in the embodiment, the processor 401 in the display apparatus loads executable file corresponding to the process of one or more application programs into the memory 402 according to following instructions, and the processor 401 runs the application program stored in the memory 402, so as to implement the various method steps provided in the foregoing embodiments. The instructions are:

obtaining the current frame display period corresponding to the current refresh frequency of the GPU, wherein the current frame display period is the sum of the duration of the frame display and the duration of the vertical blank region; determining the start time and the lasting duration of the vertical blank region based on the preset frame display duration and the current frame display period; and controlling the target image to be displayed from the start time according to the lasting duration.

In the above embodiments, the description of each embodiment has its own focus. For parts that are not described in detail in a certain embodiment, please refer to the detailed description of the information processing method above, which will not be repeated here.

It can be seen from the foregoing that the display apparatus of the embodiment of the present invention can have the following method: obtaining the current frame display period corresponding to the current refresh frequency of the GPU, wherein the current frame display period is the sum of the duration of the frame display and the duration of the vertical blank region; determining the start time and the lasting duration of the vertical blank region based on the preset frame display duration and the current frame display period; and controlling the target image to be displayed from the start time according to the lasting duration. In this way, by inserting the target image in the vertical blank region to prevent a problem of excessive grayscale brightness changes in the vertical blank region.

A person of ordinary skill in the art can understand that all or part of the steps in the various methods of the foregoing embodiments can be completed by instructions, or by instructions to control related hardware. The instructions can be stored in a computer-readable storage medium and loaded and executed by the processor.

In this way, an embodiment of the present invention provides a computer-readable storage medium in which multiple instructions are stored. The instructions can be loaded by the processor to execute the steps in any display method provided in the embodiments of the present invention. For example, the instruction can perform the following steps:

obtaining the current frame display period corresponding to the current refresh frequency of the GPU, wherein the current frame display period is the sum of the duration of the frame display and the duration of the vertical blank region; determining the start time and the lasting duration of the vertical blank region based on the preset frame display duration and the current frame display period; and controlling the target image to be displayed from the start time according to the lasting duration.

For the specific implementation of the above operations, please refer to the previous embodiments, which will not be repeated here.

The display apparatus readable storage medium may comprise read only memory (ROM), random access memory (RAM), magnetic disk, or optical disk, etc.

Since the instructions stored in the readable storage medium of the display apparatus can execute the steps in any information processing method provided in the embodiments of the present invention, therefore, the beneficial effects that can be achieved by any of the information processing methods provided in the embodiments of the present invention can be achieved. For details, please refer to the previous embodiments, which will not be repeated here.

The information processing method, apparatus, and computer-readable storage medium provided by the embodiments of the present invention are described in detail above. In this article, specific examples are used to explain the principles and implementation of the present invention. The description of the above embodiment is only used to help understand the method and core idea of the present invention. Meanwhile, for those skilled in the art, according to the idea of the present invention, there will be changes in the specific implementation and application scope. In summary, the content of this manual should not be construed as a limitation on the present invention.

What is claimed is:

1. A display method, comprising following steps:

obtaining a current refresh frequency of a GPU and determining whether the current refresh frequency is less than a preset refresh frequency;

if the current refresh frequency is less than the preset refresh frequency, a current frame display period corresponding to the current refresh frequency is obtained, wherein the current frame display period is a sum of a duration of a frame display and a duration of a vertical blank region;

determining a start time and a lasting duration of the vertical blank region based on a preset frame display duration and the current frame display period; and controlling a target image to be displayed from the start time according to the lasting duration.

2. The display method as claimed in claim 1, wherein the step of determining the start time and the lasting duration of the vertical blank region based on the preset frame display duration and the current frame display period comprises:

determining the start time and the lasting duration of the vertical blank region according to a preset frame generation duration and the current frame display period, and determining the duration from the start time of the current frame display period to an end of the current display period as the lasting duration of the vertical blank region.

3. The display method as claimed in claim 1, wherein the preset refresh frequency is any value from 70 Hz to 90 Hz.

4. The display method as claimed in claim 1, wherein the target image is a high grayscale brightness image.

5. A display apparatus, comprising a memory, a processor, and a computer program stored in the memory and executable in the processor, wherein a display method is realized when the processor executes the program, and the display method comprises following steps:

obtaining a current refresh frequency of a GPU and determining whether the current refresh frequency is less than a preset refresh frequency;

if the current refresh frequency is less than the preset refresh frequency, a current frame display period corresponding to the current refresh frequency is obtained, wherein the current frame display period is a sum of a duration of a frame display and a duration of a vertical blank region;

determining a start time and a lasting duration of the vertical blank region based on a preset frame display duration and the current frame display period; and controlling a target image to be displayed from the start time according to the lasting duration, wherein the target image is a high grayscale brightness image.

6. The display apparatus as claimed in claim 5, wherein the step of determining the start time and the lasting duration of the vertical blank region based on the preset frame display duration and the current frame display period comprises:

determining the start time and the lasting duration of the vertical blank region according to a preset frame generation duration and the current frame display period, and determining the duration from the start time of the current frame display period to an end of the current display period as the lasting duration of the vertical blank region.

7. The display apparatus as claimed in claim 5, wherein the preset refresh frequency is any value from 70 Hz to 90 Hz.

* * * * *